US006719169B1

(12) United States Patent
Gandy

(10) Patent No.: US 6,719,169 B1
(45) Date of Patent: Apr. 13, 2004

(54) TOOTHPASTE DISPENSER AND TUBE HOLDER

(76) Inventor: David L. Gandy, 6201 Alpine St., District Heights, MD (US) 20747

( * ) Notice: Subject to any disclaimer, the term of this patent is extended or adjusted under 35 U.S.C. 154(b) by 0 days.

(21) Appl. No.: 10/413,710

(22) Filed: Apr. 15, 2003

(51) Int. Cl.[7] ..... B65D 35/28

(52) U.S. Cl. ..... 222/1; 222/53; 222/44; 222/103

(58) Field of Search ..... 222/1, 93, 94, 222/101, 102, 103

(56) References Cited

U.S. PATENT DOCUMENTS

| | | | | | |
|---|---|---|---|---|---|
| 1,773,104 | A | * | 8/1930 | Johnson | 222/102 |
| 2,083,603 | A | * | 6/1937 | Harwick | 222/95 |
| 2,185,775 | A | * | 1/1940 | Ryba | 222/93 |
| 2,390,314 | A | * | 12/1945 | Broaddus | 222/103 |
| 2,921,718 | A | * | 1/1960 | Meissner | 222/103 |
| 3,155,278 | A | * | 11/1964 | Le Baron | 222/93 |
| 3,194,440 | A | * | 7/1965 | Watson, Jr. | 222/93 |
| 3,908,863 | A | * | 9/1975 | White | 222/103 |
| 4,270,672 | A | * | 6/1981 | Kraals | 222/103 |
| 4,976,380 | A | * | 12/1990 | von Schuckmann | 222/103 |
| 5,178,302 | A | * | 1/1993 | Cheng | 222/102 |
| 5,222,629 | A | * | 6/1993 | Tal | 222/103 |
| 5,330,077 | A | * | 7/1994 | Swanson | 222/103 |

* cited by examiner

*Primary Examiner*—Kenneth Bomberg

(57) ABSTRACT

A toothpaste dispensing and tube-storing unit that can neatly store multiple tubes of toothpaste in separate compartments and easily and efficiently be used to dispense toothpaste from the tubes. The unit can hold one or more toothpaste tubes, as well as several toothbrushes. Each compartment is open at the top and bottom ends and has a spring-loaded pressure squeeze-bar assembly mounted inside and near the bottom of the compartment. The front of each compartment has an open slot extending from the top opening to near the bottom of the unit for accessing a tube of toothpaste. The unit can be mounted on the wall for easy access. The toothpaste tube is inserted, cap end up, from the top of the compartment with the bottom end of the tube being inserted between two spring-loaded pressure squeeze-bars. When the bottom end of a tube is pulled downward, toothpaste is dispensed from the open top of the tube by means of pressure applied by the squeeze-bars. The pressure squeeze-bar mechanism will allow the tube to be squeezed flat, thereby allowing practically all of the toothpaste to be removed from a tube. In use, the cap is removed from one of the tubes and the bristles of a toothbrush are held over the tube opening with one hand. The bottom end of the tube is then pulled downward with the other hand, thereby dispensing toothpaste out of the tube on to the brush bristles. Furthermore, a stop guide means can be added to allow the tube to be pulled down a constant distance in order to dispense an equal amount of toothpaste each time the dispenser is used.

20 Claims, 3 Drawing Sheets

TOOTHPASTE DISPENSER AND TUBE HOLDER

BACKGROUND OF THE INVENTION

1. Field of the Invention

The present invention relates to a toothpaste dispenser for use in connection with improving the oral hygiene process. The toothpaste dispenser has particular utility in connection with organizing multiple toothpaste tubes and brushes for various family members and easily and efficiently dispensing toothpaste from the tubes on to the brushes.

2. Description of the Prior Art

A familiar site in many bathrooms is that of half-squeezed toothpaste tubes lying on the counter top or stuffed in drawers. A desirable item in many of these bathrooms would be apparatus for neatly organizing these toothpaste tubes and efficiently dispensing toothpaste from the tubes, especially where various family members prefer different brands of toothpaste.

Apparatus for dispensing toothpaste is known in the prior art. For example, U.S. Pat. No. 5,277,332 to Rogers discloses apparatus that has multiple dispensing containers for viscous materials, cups, and toothpaste. However, the Rogers '332 patent does not utilize a dispensing mechanism where the tube is simply pulled downward, as does the present invention, but rather uses a winding-key to dispense the toothpaste.

Similarly, U.S. Pat. No. 5,215,218 to Choi discloses an electric toothpaste dispenser that dispenses toothpaste at the push of a button. However, the Choi '218 patent has major structural differences from the present invention, and does not utilize a dispensing mechanism where the tube is simply pulled downward to dispense the toothpaste from the tube, as does the present invention.

U.S. Design Pat. No. D395,972 to Levy discloses the design of a combined display and dispensing unit that allows for multiple products, such as soap and shampoo, to be dispensed and could possibly be modified for use in dispensing toothpaste. However, the Levy '972 patent has structural differences from the present invention and does not utilize a dispensing mechanism where the toothpaste tube is simply pulled downward to dispense the toothpaste.

Lastly, U.S. Pat. No. 2,760,681 to Arquelles et al., U.S. Pat. No. 4,303,110 to Chen, and U.S. Pat. No. 2,609,122 to Stenerson discloses apparatus that may be of general interest and pertinent to the construction and design of the present invention. The Arquelles '681 patent discloses a packaged toothpaste holder and toothpaste dispenser that uses a tube key-wind dispensing mechanism. The Chen '110 patent discloses a toothpaste dispenser that uses a vacuum pump of piston-cylinder construction to draw the toothpaste out of the tube. Finally, the Stenerson '122 patent discloses a dentifrice cabinet that could be used to dispense toothpaste. However, all of these patents disclose apparatus that is structurally different from the present invention, and none utilize a dispensing mechanism where the tube is simply pulled downward to dispense the toothpaste from the tube.

While the above-described devices fulfill their respective, particular objectives and requirements, the aforementioned patents do not describe a toothpaste dispenser that allows the tube to simply be pulled downward to dispense the toothpaste.

Therefore, a need exists for a new and improved toothpaste dispenser that can be used with multiple tubes of toothpaste and is operated by simply pulling down on the toothpaste tube extending from the bottom of the unit. In this regard, the present invention substantially fulfills this need. In this respect, the toothpaste dispenser according to the present invention substantially departs from the conventional concepts and designs of the prior art, and in doing so provides an apparatus primarily developed for the purpose of both neatly organizing the tubes and dispensing various brands of toothpaste.

SUMMARY OF THE INVENTION

In view of the foregoing disadvantages inherent in the known types of toothpaste dispensers now present in the prior art, the present invention provides an improved toothpaste dispenser, and overcomes the above-mentioned disadvantages and drawbacks of the prior art. As such, the general purpose of the present invention, which will be described subsequently in greater detail, is to provide a new and improved toothpaste dispenser that has all the advantages of the prior art mentioned heretofore and other novel features that result in a dispenser which is not anticipated, rendered obvious, suggested, or even implied by the prior art, either alone or in any combination thereof.

To attain this, the present invention essentially comprises a rectangular storage unit that can hold (store) one, two, four, or more (any number) of toothpaste tubes and conveniently dispense toothpaste from the tubes. The unit will typically be 3 to 12-inches long by 2 to 3-inches deep by 4 to 6-inches high, depending on the number of tube storage compartments. In addition, the unit will contain storage area for toothbrushes. More specifically, each compartment is open at the top and bottom ends and has a spring-loaded pressure squeeze-bar assembly mounted inside and near the bottom of the compartment. The front of each compartment has an open slot extending from the open top to near the bottom of the unit for accessing an inserted tube of toothpaste. The unit can be mounted on the wall for easy access. The toothpaste tube is inserted, cap end up, from the top of the compartment with the bottom end of the tube being inserted between two spring-loaded pressure squeeze-bars. When the bottom end of a tube is pulled downward, toothpaste is dispensed from the open top of the tube by means of the pressure squeeze-bars pressing against the tube. The pressure squeeze-bar mechanism will allow the tube to be squeezed flat, thereby allowing practically all of the toothpaste to be removed from the tube.

In use, the cap is removed from one of the tubes and the bristles of a toothbrush are held over the tube opening with one hand. The bottom end of the tube is then pulled downward with the other hand, thereby dispensing toothpaste out of the tube on to the brush bristles. Furthermore, a stop guide means can be added to allow the tube to be pulled a constant distance in order to dispense an equal amount of toothpaste each time the device is used.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention is to provide a new toothpaste dispenser that provides in the apparatuses and methods of the prior art some of the advantages thereof, while simultaneously overcoming some of the disadvantages normally associated therewith.

It is another object of the present invention to provide a new and improved toothpaste dispenser that may be easily and efficiently manufactured and marketed.

An even further object of the present invention is to provide a new and improved toothpaste dispenser that has a low cost of manufacture with regard to both materials and labor, and which accordingly is then susceptible of low prices of sale to the consuming public, thereby making such products economically available to the buying public.

Lastly, it is an object of the present invention to provide a new and improved method for the oral hygiene process of brushing one's teeth while providing a neat and orderly storage area of a number of toothpaste tubes and toothbrushes.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
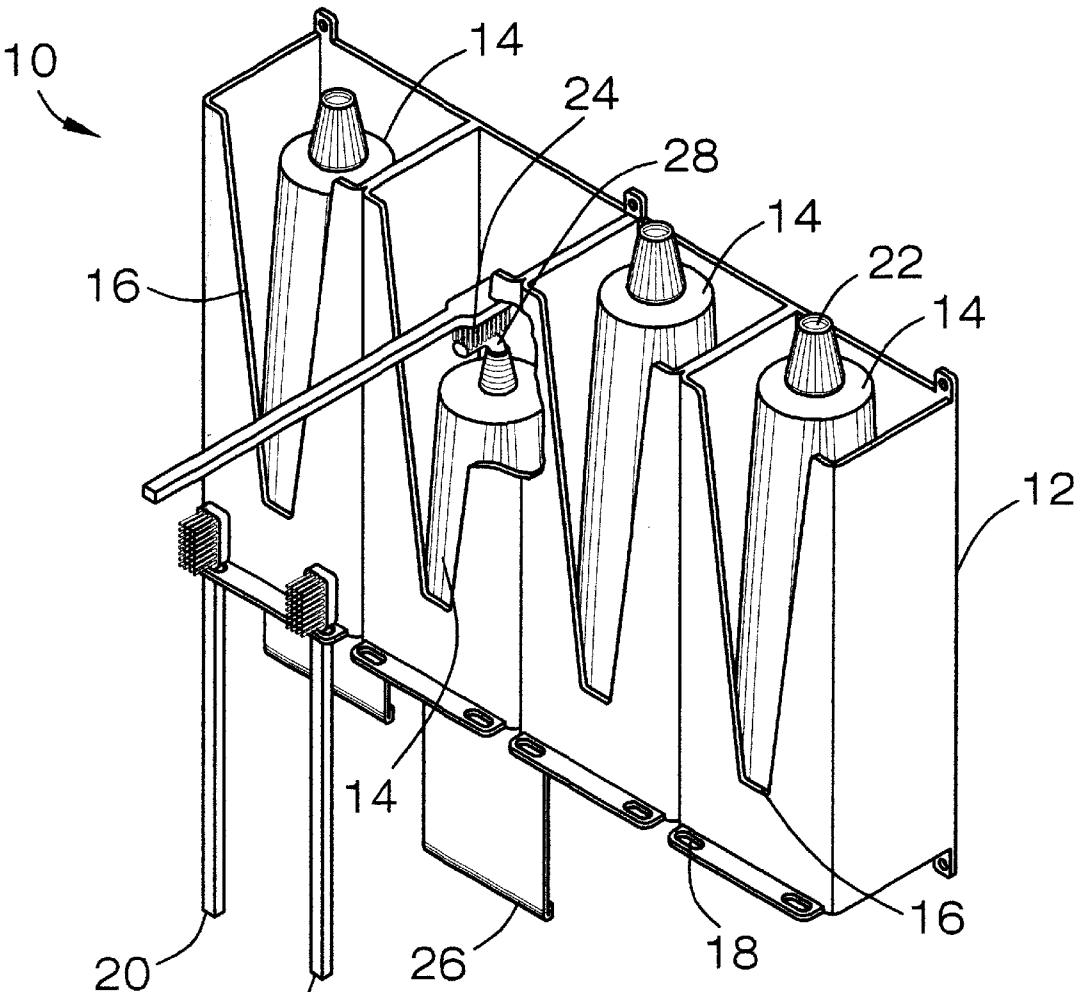
FIG. 1 is a perspective view of the preferred embodiment of the toothpaste dispenser and tube holder constructed in accordance with the principles of the present invention.

Referring now to the drawings, and particularly to FIGS. 1–6, a preferred embodiment of the toothpaste dispenser and tube holder of the present invention is shown and generally designated by the reference numeral 10.

Figure 3:
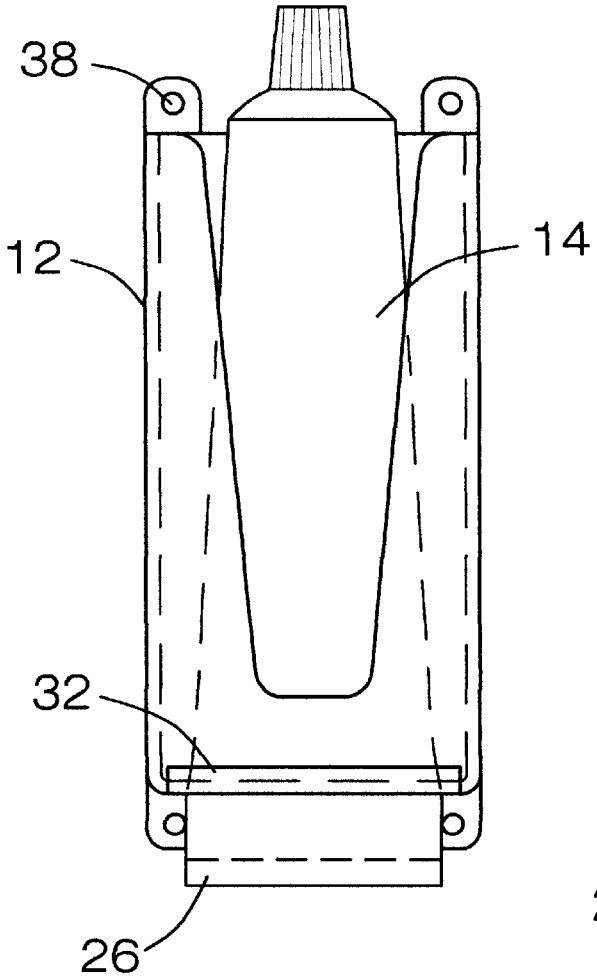
FIG. 3 is a front view of the toothpaste dispenser and tube holder of the present invention.
Figure 2:
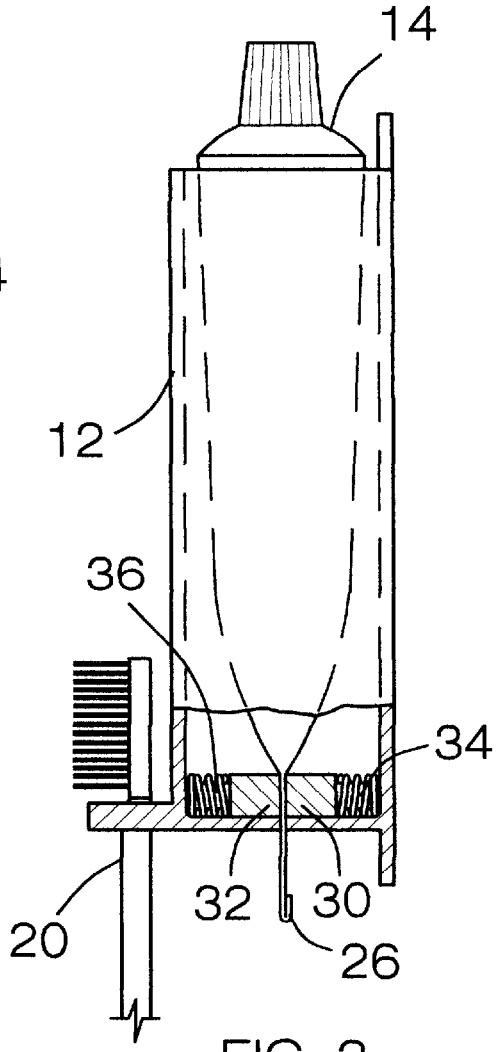
FIG. 2 is a side view of the toothpaste dispenser and tube holder of the present invention.

In FIGS. 1–3, a perspective view along with side and front views of the new and improved toothpaste dispenser and tube holder 10 of the present invention for neatly organizing and efficiently dispensing toothpaste from multiple tubes is shown, which illustrates and describes the dispenser. More particularly, the toothpaste dispenser 10 has an outer housing 12 that forms one or more toothpaste tube compartments with each compartment being open at the top and bottom. The housing 12 has solid back and side panels and a front panel having open access slots 16, which extend from the top opening down near the bottom of the unit. The unit further has built-in toothbrush holders 18 and mounting holes 38 for use in attaching the unit to a bathroom or other wall. A spring-loaded pressure squeeze-bar mechanism is used to dispense the toothpaste from the toothpaste tubes 14. This mechanism has two parallel bars 30,32 that are pressed against the front and back of the tube 14 by means of springs 34,36, which flattens the tube as it is pulled between the bars, thereby dispensing toothpaste 28 through the opening at the top end of the tube.

Figure 4:
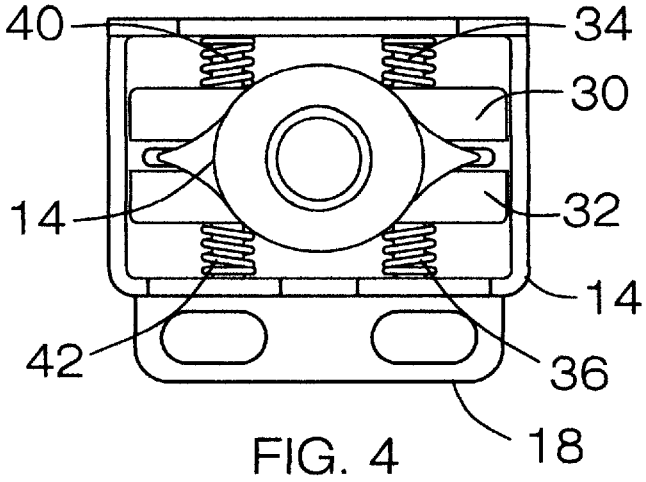
FIG. 4 is a top view of the toothpaste dispenser and tube holder of the present invention.

FIG. 4 is a top view of one of the tube compartments of the toothpaste dispenser of the present invention, which shows more detail of the spring-loaded pressure squeeze-bar mechanism. The pressure squeeze-bar mechanism is mounted inside each of the compartments near the bottom opening and is comprised of a front pressure squeeze-bar 32 and a back pressure squeeze-bar 30, which press against the front and back surfaces of the tube 14 by means of at least two springs 36,42 and 34,40 for the front and back pressure squeeze-bars, respectively. These springs 36,42 and 34,40 are compressed between the front 32 and back 30 pressure squeeze-bars and the front and back panels of the unit's housing 14, respectively.

This invention provides an oral hygiene method for brushing one's teeth, which is convenient, easy to use, and provides neatly organized products. In use, the cap 22 is removed from one of the toothpaste tubes 14, which can be of various toothpaste product brands. A toothbrush 20 is removed from its holder 18 and the brush bristles 24 held over the tube's 14 open end with one hand. The bottom of the tube 26 is then pulled downward with the other hand, squeezing the tube between the squeeze bars, thereby dispensing toothpaste 28 from the tube 14 on to the bristles 24 of the toothbrush 20.

Figure 5:
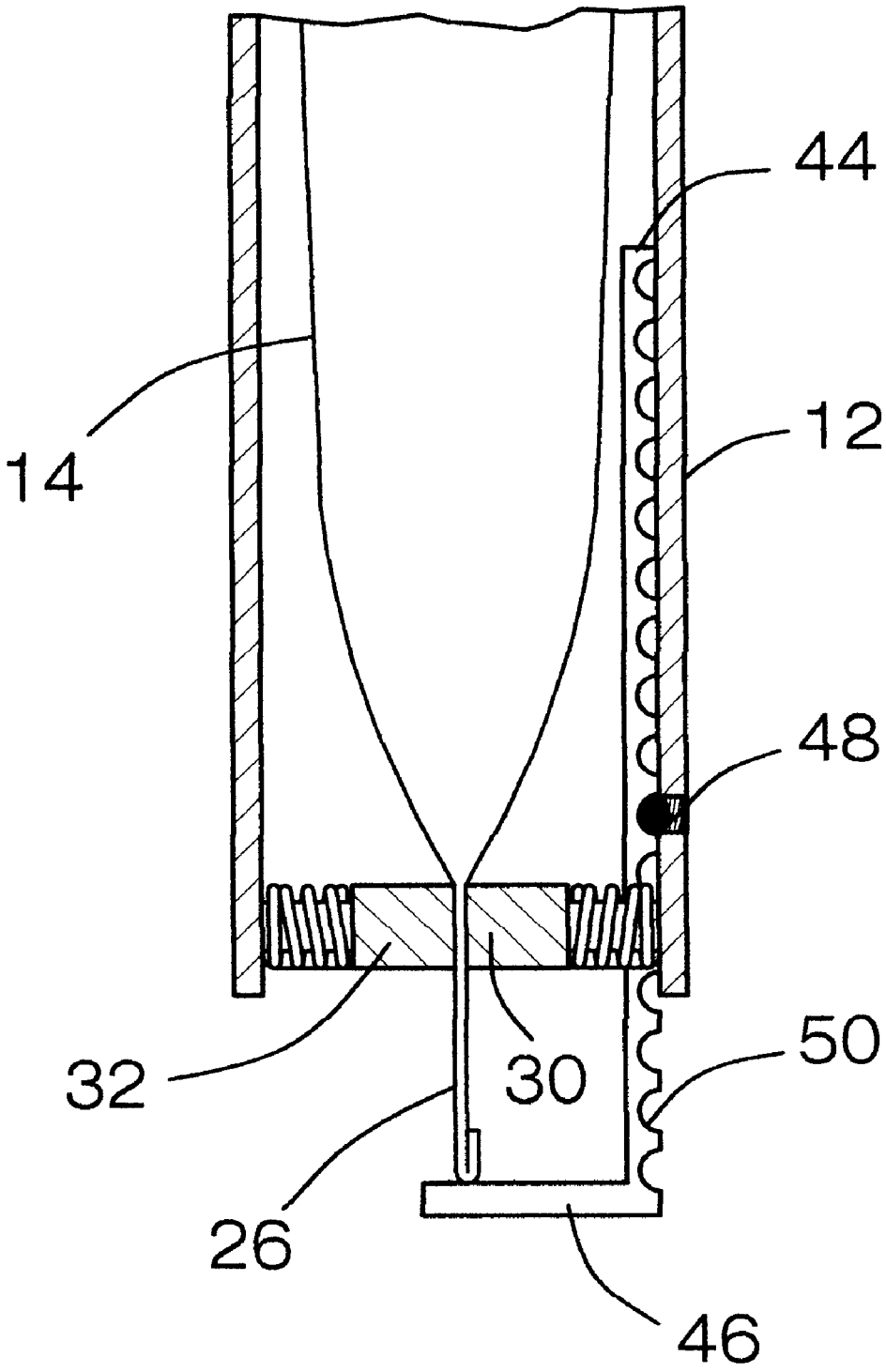
FIG. 5 is a drawing illustrating one embodiment for a stop guide for use with the toothpaste dispenser of the present invention.

Additionally, FIG. 5 is a drawing illustrating one embodiment for a stop guide for use with the toothpaste dispenser of the present invention. This guide can be added to the unit to allow the tube to be pulled a constant distance in order to dispense an equal amount of toothpaste each time it is used. Here, an arm 44 is attached to the inside center of the back panel of the housing 12 by appropriate mounting means. The arm 44 extends downward out from the bottom of the unit, such that it can be pulled down one notch each time the dispenser is used to provide a stop 46 below the bottom end of the tube 26, thereby indicating how far to pull the tube. A spring-loaded BB 48 is compressed between a hole in the back panel of the housing 12 and one of a continuous series of indentions 50 in the arm 44. In use, the guide is pulled down one notch (one indention 50 spacing) each time the dispenser is use, thereby placing the stop guide slightly below the bottom 26 of the toothpaste tube 14. The user can then pull the bottom of the tube 26 down to contact the guide, thereby dispensing a controlled amount of toothpaste.

While a preferred embodiment of the toothpaste dispenser and tube holder has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, any suitable sturdy material such as plastic, metal, wood, or a variety of other solid materials may be used to fabricate the housing. Also, the pressure squeeze-bars can be made from formed metal, molded metal, molded plastic, or similar materials.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claim is:

1. A toothpaste dispenser and tube holder, comprising:

a housing forming a toothpaste tube compartment, said housing having an open top and bottom, said housing further having solid back and side panels, said housing further having a front panel defining a slot therein, said slot extending downward from the top opening to near the bottom of said housing;

a means for dispensing toothpaste from a toothpaste tube by manually pulling said tube between two pressure squeeze-bars; and a toothbrush holder means attached to the outside of said housing.

2. The toothpaste dispenser of claim 1, wherein said housing is further comprised of two or more adjacent said toothpaste tube holder compartments.

3. The toothpaste dispenser of claim 1, wherein said housing further comprises a wall mounting means.

4. The toothpaste dispenser of claim 1, said housing being fabricated from materials from the group comprising: molded plastic, formed metal, wood, and hard rubber.

5. The toothpaste dispenser of claim 1, said pressure squeeze-bars being fabricated from materials from the group comprised of: molded plastic, aluminum, and molded metal.

6. The toothpaste dispenser of claim 1, wherein said toothbrush holder means has openings for holding one or more toothbrushes.

7. The toothpaste dispenser of claim 1, wherein said means for dispensing toothpaste further has built-in stop guide means for limiting how far said tube can be pulled for each dispensation, thereby dispensing an equal amount of toothpaste each time said dispenser is used.

8. A toothpaste dispenser and tube holder, comprising:

a housing forming a toothpaste tube compartment, said housing having an open top and bottom, said housing further having solid back and side panels, said housing further having a front panel defining a slot therein, said slot extending downward from the top opening to near the bottom of said housing;

a means for dispensing toothpaste from a toothpaste tube by manually pulling said tube between two pressure squeeze-bars, said means for dispensing toothpaste further comprising:

a first pressure squeeze-bar springably mounted in front and inside said toothpaste tube compartment just above said bottom opening of said housing;

a second pressure squeeze-bar springably mounted in back and inside said toothpaste tube compartment just above said bottom opening of said housing, said first and second pressure squeeze-bars being aligned adjacent to one another, said toothpaste tube being placed between said first and second pressure squeeze-bars; and a toothbrush holder means attached to the outside of said housing.

9. The toothpaste dispenser of claim 8, wherein each said pressure squeeze-bar is springably mounted by means of at least two springs compressed between said pressure squeeze-bars and said front and back panels of said housing, respectively.

10. The toothpaste dispenser of claim 8, wherein said housing is comprised of two or more adjacent said toothpaste tube compartments.

11. The toothpaste dispenser of claim 8, wherein said housing further comprises a wall mounting means.

12. The toothpaste dispenser of claim 8, said housing being fabricated from materials from the group comprising: molded plastic, formed metal, wood, and hard rubber.

13. The toothpaste dispenser of claim 8, said pressure squeeze-bars being fabricated from materials from the group comprised of: molded plastic, aluminum, and molded metal.

14. The toothpaste dispenser of claim 8, wherein said toothbrush holder means has openings for holding one or more toothbrushes.

15. The toothpaste dispenser of claim 8, wherein said means for dispensing toothpaste further has a built-in stop guide means for limiting how far said tube can be pulled for each dispensation, thereby dispensing an equal amount of toothpaste each time said dispenser is used.

16. A method for dispensing toothpaste, comprising:

providing a dispenser for one or more toothpaste tubes, said dispenser further comprising:

a housing forming one or more toothpaste tube compartments, said housing having an open top and bottom, said housing further having solid back and side panels, said housing further having a front panel defining a slot opening therein, said slot opening extending downward from the top opening to near the bottom of said housing;

a means for dispensing toothpaste from said toothpaste tubes by manually pulling each said tube downward between two pressure squeeze-bars, said means further comprising:

a first pressure squeeze-bar springably mounted in front and inside said toothpaste tube compartments just above said bottom opening of said housing;

a second pressure squeeze-bar springably mounted in back and inside said toothpaste tube compartments just above said bottom opening of said housing, said first and second pressure squeeze-bars being aligned adjacent to one another, said toothpaste tube being placed between said first and second pressure squeeze-bars; and a toothbrush holder means provided on the front outside of said housing, said toothbrush holder holding one or more toothbrushes;

inserting toothpaste tubes, cap side up, in said toothpaste tube compartments;

removing the cap from one of said toothpaste tubes;

removing a toothbrush from said toothbrush holder;

placing the bristles of said toothbrush over the open top of said toothpaste tube;

grasping said bottom of said toothpaste tube from the bottom of said housing;

pulling said toothpaste tube downward between said first and said second pressure squeeze-bars, thereby dispensing said toothpaste from said tube on to said toothbrush bristles;

removing said toothbrush from said dispenser; and replacing said cap on said toothpaste tube.

17. The method of claim 16, wherein each said pressure squeeze-bar is springably mounted by means of at least two springs compressed between each said pressure squeeze-bar and said front and back panels of said housing, respectively.

18. The method of claim 16, wherein said housing further comprises a wall mounting means.

19. The method of claim 16, said housing being fabricated from materials from the group comprising: molded plastic, formed metal, wood, and hard rubber.

20. The method of claim 16, wherein said means for dispensing toothpaste further has a built-in stop guide means for limiting how far said tube can be pulled for each dispensation, thereby dispensing an equal amount of toothpaste each time said dispenser is used.

* * * * *